US007666280B2

(12) United States Patent
Kersternich

(10) Patent No.: US 7,666,280 B2
(45) Date of Patent: Feb. 23, 2010

(54) COKING DRUM

(75) Inventor: Ludwig Kersternich, Hürtgenwald (DE)

(73) Assignee: Z&J Technologies GmbH (DE)

( * ) Notice: Subject to any disclaimer, the term of this patent is extended or adjusted under 35 U.S.C. 154(b) by 287 days.

(21) Appl. No.: 11/624,569

(22) Filed: Jan. 18, 2007

(65) Prior Publication Data

US 2008/0047873 A1 Feb. 28, 2008

Related U.S. Application Data

(63) Continuation of application No. 10/942,308, filed on Sep. 16, 2004, now abandoned.

(30) Foreign Application Priority Data

Sep. 18, 2003 (DE) ..... 103 43 298

(51) Int. Cl.
*C10B 25/00* (2006.01)

(52) U.S. Cl. ..... 202/241; 202/242; 202/244; 202/245; 202/262

(58) Field of Classification Search ..... 202/241, 202/242, 245, 244, 262; 251/193, 203, 204, 251/326, 368
See application file for complete search history.

(56) References Cited

U.S. PATENT DOCUMENTS

| | | | | |
|---|---|---|---|---|
| 1,482,677 | A | 2/1924 | Dunten | |
| 1,709,815 | A | 4/1929 | Henry | |
| 2,283,556 | A | 5/1942 | Karrick | |
| 2,310,748 | A | 2/1943 | Pearson | |
| 2,317,566 | A | 4/1943 | Utterback | |
| 2,778,781 | A | 1/1957 | Smith | |
| 5,116,022 | A | 5/1992 | Genreith et al. | |
| 5,417,811 | A | 5/1995 | Malsbury | |
| 5,565,714 | A | 10/1996 | Cunningham | |
| 5,667,196 | A * | 9/1997 | Irnich | 251/193 |
| 5,927,684 | A | 7/1999 | Marx et al. | |
| 6,660,131 | B2 | 12/2003 | Lah | |
| 6,843,889 | B2 | 1/2005 | Lah et al. | |
| 6,964,727 | B2 | 11/2005 | Lah | |
| 6,989,081 | B2 * | 1/2006 | Lah | 202/245 |
| 7,037,408 | B2 * | 5/2006 | Wilborn et al. | 201/2 |
| 2004/0118746 | A1 | 6/2004 | Wilborn et al. | |
| 2004/0154913 | A1 | 8/2004 | Lah | |

(Continued)

FOREIGN PATENT DOCUMENTS

| | | |
|---|---|---|
| GB | 1 275 194 | 5/1972 |

(Continued)

OTHER PUBLICATIONS

Zimmermann & Jansen brochure entitled "Through Conduit Type Valve Double Disc Design", Cat. No. ZJ 3007 P1-4 (P500 E 06.97).

(Continued)

*Primary Examiner*—Nina Bhat
(74) *Attorney, Agent, or Firm*—Alston & Bird LLP

(57) ABSTRACT

Coking drum 3, 4, especially for the manufacture of petroleum coke, which has an approximately cylindrical basic body, at least one inlet and at least two outlets, wherein there is arranged as shut-off member (11) at least at one outlet and/or at the or one inlet, a bridging pipe slide valve having two shut-off plates 27, 28.

12 Claims, 5 Drawing Sheets

U.S. PATENT DOCUMENTS

| | | | | |
|---|---|---|---|---|
| 2004/0200715 | A1 | 10/2004 | Lah | |
| 2004/0238408 | A1 * | 12/2004 | Malsbury | 208/131 |
| 2005/0034969 | A1 | 2/2005 | Lah et al. | |
| 2005/0194245 | A1 | 9/2005 | Lah | |

FOREIGN PATENT DOCUMENTS

| | | | |
|---|---|---|---|
| SU | 1518349 | A1 | 10/1989 |
| WO | WO 02/072729 | A1 | 9/2002 |

OTHER PUBLICATIONS

Zimmermann & Jansen brochure entitled "Through Conduit Type Valve Single Disc Design", Cat. No. ZJ 3008 P1-4 (P500 E 06.97).

* cited by examiner

COKING DRUM

CROSS-REFERENCE TO RELATED APPLICATIONS

This application is a continuation of U.S. application Ser. No. 10/942,308, filed Sep. 16, 2004, now abandoned and also claims the benefit of German Priority Application No. 103 43 298.1, filed Sep. 18, 2003, all of which are incorporated by reference herein in their entirety.

BACKGROUND OF THE INVENTION

1. Field of the Invention

The present invention relates to a coking drum according to the preamble of claim 1 and to a coking method, which is designed especially for coking residues from the vacuum distillation of crude oil, according to the preamble of claim 13.

2. Description of Related Art

In crude oil processing, value is increasingly being placed on the further processing of heavy products left over from the distillation of crude oil to lighter products. Accordingly the production of heavy heating oil is to be reduced and the production of gasoline, diesel fuel and light heating oil increased without the need to process additional crude oil. The plants required for that purpose, which operate according to various methods, are called conversion plants. They convert heavy, long hydrocarbon molecules into light, shorter hydrocarbon molecules by cracking the long molecules. A distinction is made between three such cracking methods: thermal cracking, catalytic cracking and hydrocracking. The optimum combination of methods depends on several factors which include, inter alia, the quality of the crude oil in question and the products desired. The various cracking methods are based on different feed products, gas oil from vacuum distillation acting as the feed product for catalytic cracking units and hydrocrackers, and the residue from vacuum distillation being used as feed product in visbreakers or cokers.

The longest known and simplest cracking method is thermal cracking. In that method hydrocarbon chains are cracked at high temperatures. The group of thermal cracking methods includes visbreaking and coking in which carbon in solid form, so-called coke or petroleum coke, is deposited.

There are three different methods of coking, namely fluid coking, delayed coking and flexicoking. The most frequently used method is delayed coking. In that method the feed product which, for example, may be the residue from vacuum distillation, is introduced into a furnace at a pressure of about 30 bar and heated to about 500° C. As a result of those conditions, the feed product flows through the furnace at very high speed and then cokes when admitted into a coking chamber or coking drum having a prevailing pressure of about 4 bar that is separate from the furnace and connected thereto by a pipeline.

There are generally associated with each furnace at least two coking drums, one of those chambers in each furnace being in operation, while coke is being removed from the other. The coke can be cut out of the coking drum by means of, for example, water under elevated pressure. The light hydrocarbons produced during the coking process are conveyed from the coking chamber into a fractionating tower where they are further processed. The resulting petroleum coke is called green coke and, after being comminuted, can either be sold or further refined. Further refining takes place in a calcining process in which, at temperatures of 1200° C. and above, any oil constituents still present are burnt off and coked. The calcination product obtained in that process can then be used, for example, for electrodes, which are employed in the aluminium industry.

The drum that has been filled is cooled, and the coke is removed. For that purpose water is first of all introduced into the drum in order to cool the hot coke obtained. The drum is then opened to the atmosphere by, depending on the design of the coking chamber or drum, either only the bottom end of the drum or chamber being opened or also the top end of the drum or chamber being opened, so that the coke can be cut out of the drum and delivered for further use.

The operation of opening the coking drum may present sources of risk for several reasons. The water introduced into the drum for cooling the coke prior to the drum being opened is very hot, and, if the equipment is not handled carefully, may result in injuries caused by the emerging hot water or steam, which is under pressure. In addition, loose bits of coke may fall out of the drum or place such a strain on the opening mechanisms that, after they have been unlocked, open abruptly, which may also result injuries to the operating personnel. The operating personnel may also be exposed to dust, especially coke particles and also irritant or noxious gases, when the drums are opened.

To reduce the sources of risk to operating personnel, a change was made from opening the coking drums manually to opening them automatically by means of dedicated, for example hydraulic, operation of the lid. Such a coking drum having an automatic opening mechanism is known from WO 02/072729 A1. The coking drum-opening device illustrated in that specification is an automatically operated slide valve which, in the open position, allows entry to the coking drum whilst, in the closed position, the slide plate seals the coking drum from the atmosphere.

A disadvantage of the device mentioned is the moderate reliability in respect of unintentional escape of hot water or steam and gases from the coking drum. In addition, malfunctions structurally may occur, since coke or the like bakes onto the guide rails of the slide valve, especially on the side of the guide rails facing the coking chamber.

BRIEF SUMMARY OF THE INVENTION

The aim of the present invention is accordingly to provide a coking drum of which the closure is reliable in terms of operation and malfunction.

An important point of the invention is accordingly that there is arranged as shut-off member, at an outlet and/or at or near to an inlet and/or at an access opening in the coking drum, a bridging pipe slide valve having two shut-off plates. By that means it is possible for the coking chamber to be shut off with increased reliability. On the one hand, this represents a move away from the known closures having a screw connection and, on the other hand, an improvement has been made in two respects compared with the slide valve closures already known: firstly, a double-plate slide valve is provided for the first time in that form and, secondly, the concept of the bridging pipe slide valve belongs to the present invention.

In a preferred embodiment, the two shut-off plates are wholly metallic sealing seats which are parallel to each other. They are distinguished by an excellent sealing action.

In a further preferred embodiment, sealing seat faces associated with the sealing seats have a wear-resistant and corrosion-resistant hard-armouring. As a result, the abrasive wear on the sealing seat faces is minimized, the maintenance intervals are extended, and cost savings are consequently possible. The two shut-off plates are preferably movably mounted in a spectacle-shaped plate box, making maintenance of the device according to the invention even simpler.

Preferably, a bridging pipe which, when the bridging pipe slide valve is in an open position, connects to each other two pipe sockets which are arranged at the side of the bridging pipe slide valve facing the interior of the coking drum (3, 4) and at the opposite side thereto, is formed as a hollow cylinder, especially a circular cylinder. The bridging pipe has a smooth surface with as little as possible roughness in order to minimise flow losses. In a further embodiment, the bridging pipe has a wear-resistant and corrosion-resistant hard-armouring or coating on its inner face, or is hardened there. As a result the abrasive wear on the bridging pipe is kept as low as possible.

Preferably, the shut-off plates are, in the closed position, pressed against sealing faces by wedge members, which are centred by means of a cone. This solution is likewise distinguished by its low susceptibility to malfunction. Baking of coke or the like on the guide rails of the shut-off plates is avoided by the pressing of the latter into the sealing position.

In a further preferred embodiment, a slide valve associated with the shut-off plates is provided with guide plates which are in permanent metallic contact with the plate box. This promotes the sealing action and reduces abrasive wear. Preferably, a control rod associated with the shut-off plates is inserted fluid-tight into the slide valve housing, a connection for connecting to a pressurised gas source, especially for connecting to a flushing or shut-off steam source, being provided on the slide valve housing. Optimal cleaning of the slide valve housing can be effected by the continuous introduction of flushing or shut-off steam, thereby increasing the lack of susceptibility to malfunction of the coking drum according to the invention. In addition, the sealing action is strengthened by the action of pressure on the shut-off plates. The steam thus has a double function: on the one hand it is used for cleaning purposes, and on the other hand it effects an additional seal at two sealing faces.

If the bridging pipe slide valve of the coking chamber according to the invention additionally has a compensator unit, which offers the advantage of being able to compensate in a simple manner for small gaps or alignment inaccuracies, then the pressurised gas connection offers further advantages. By the action of pressurised gas, preferably flushing steam, on the slide valve housing, the sealing action of the bridging pipe slide valve can be additionally strengthened also when the slide valve is in the open position. The use of flushing steam thus presents a potential cost saving, since its use is necessary for cleaning the interior of the housing or the guide plates and the plate box. The flushing steam thus, on the one hand, serves to improve the sealing action and, on the other hand, simultaneously serves to clean the closure device of the coking drum according to the invention.

In a preferred embodiment, hoods having a columnar cap for receiving the drive are flange-mounted on the slide valve housing. That embodiment is distinguished by an especially simple construction.

In a further embodiment, as has already been mentioned, the bridging pipe slide valve has a compensator unit. The compensator unit offers the advantage that small gaps and alignment inaccuracies can be compensated in a simple manner, resulting in an excellent sealing function in any situation.

In a preferred embodiment, the compensator comprises a wavelike-curved pipe portion having a concavity extending over the circumference, the wavelike-curved pipe portion, as outer pipe portion, extending coaxially above an inner pipe portion, which is joined in fixed manner to only one of the two sealing rings whilst being axially movable in relation to the other sealing ring. Such an embodiment is distinguished by a simple construction.

From a process technology point of view, an essential feature of the invention is that there used as a shut-off member for the coking chamber at least one bridging pipe slide valve having two shut-off plates. The advantages of the process according to the invention are thus obtained analogously to the above description of the apparatus claims.

In a preferred embodiment of the process according to the invention, when the coking drum is being opened use is made of the pressure prevailing inside the drum to push the shut-off plate facing the interior of the drum from its associated sealing seat. This reduces the force required to open a coking drum and its shut-off member.

BRIEF DESCRIPTION OF THE SEVERAL VIEWS OF THE DRAWING(S)

Further advantages and features of the invention are described hereinbelow by way of example and with reference to the accompanying drawings. In the drawings.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
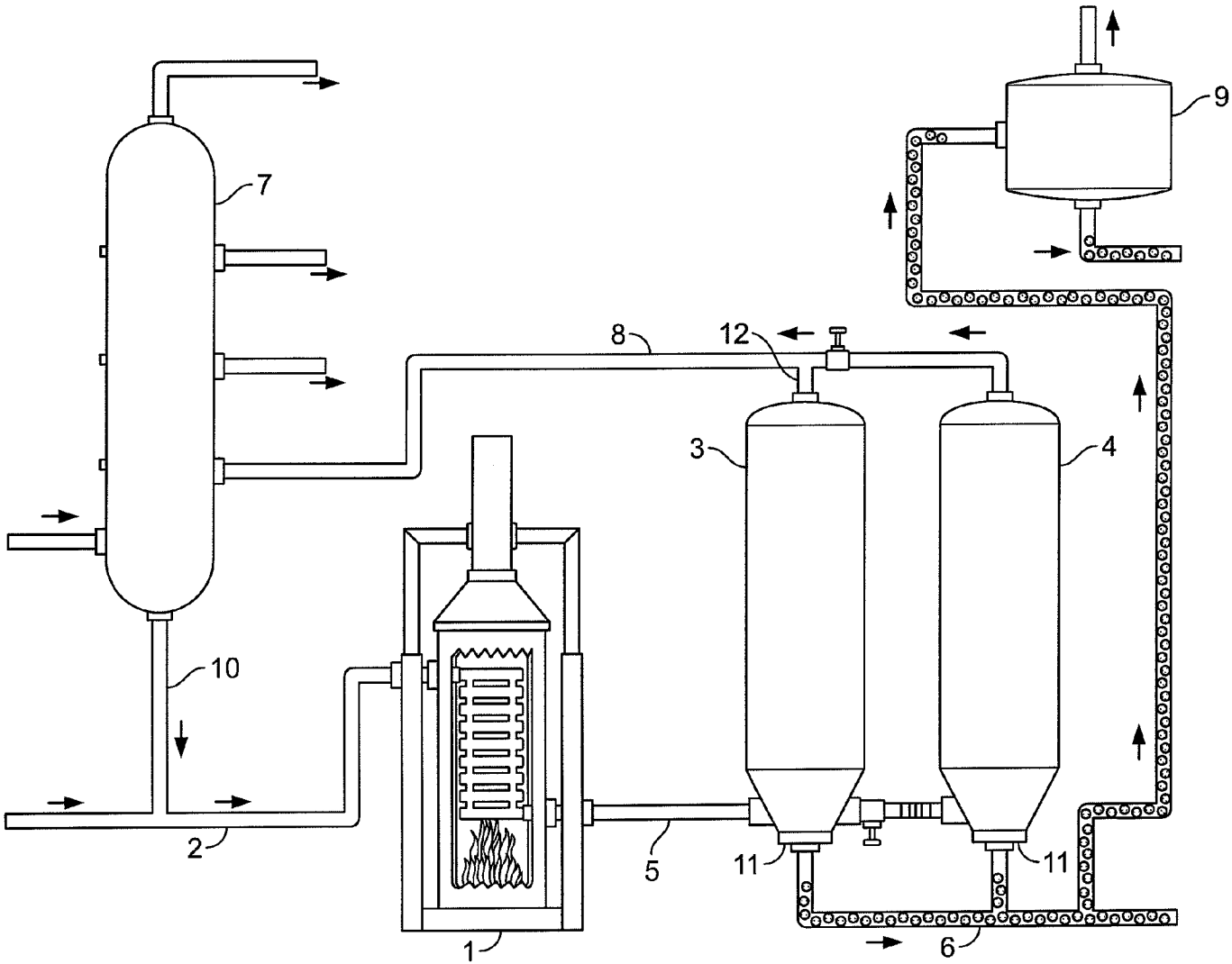
FIG. 1 is a diagrammatic view of the construction of a coking plant.

FIG. 1 is a diagrammatic illustration of a coking plant, which consists of: a furnace 1 which, by way of a pipeline 2, is fed with the residues from the vacuum distillation of crude oil; two coking chambers 3, 4, which are fed by way of a pipeline 5 with the vacuum distillation residues that have been heated in the furnace; a conveyor belt 6, by which the coke produced in the coking chambers is further transported; and a fractionating column 7 in which the gases produced in the coking chambers 3 and 4 during the coking process, which are fed to the fractionating column 7 by way of a pipeline 8, are fractionated.

In addition, the coking plant has a furnace 9 having a rotating tray in which at least portions of the coke obtained in the coking chamber are calcined. The heavy residues left over in the fractionating column 7 are fed back by way of an outlet 12 and a pipeline 10 into the pipeline 2 and thus to the coking process again. At this point it may be mentioned that the coking chambers 3, 4 can be opened both at only one end, to remove coke that has collected therein, and at both ends, that is at a top and a bottom end, to ensure simplified removal. For that purpose a shut-off member 11 is opened and then the coke is removed using suitable aids.

Figure 2:
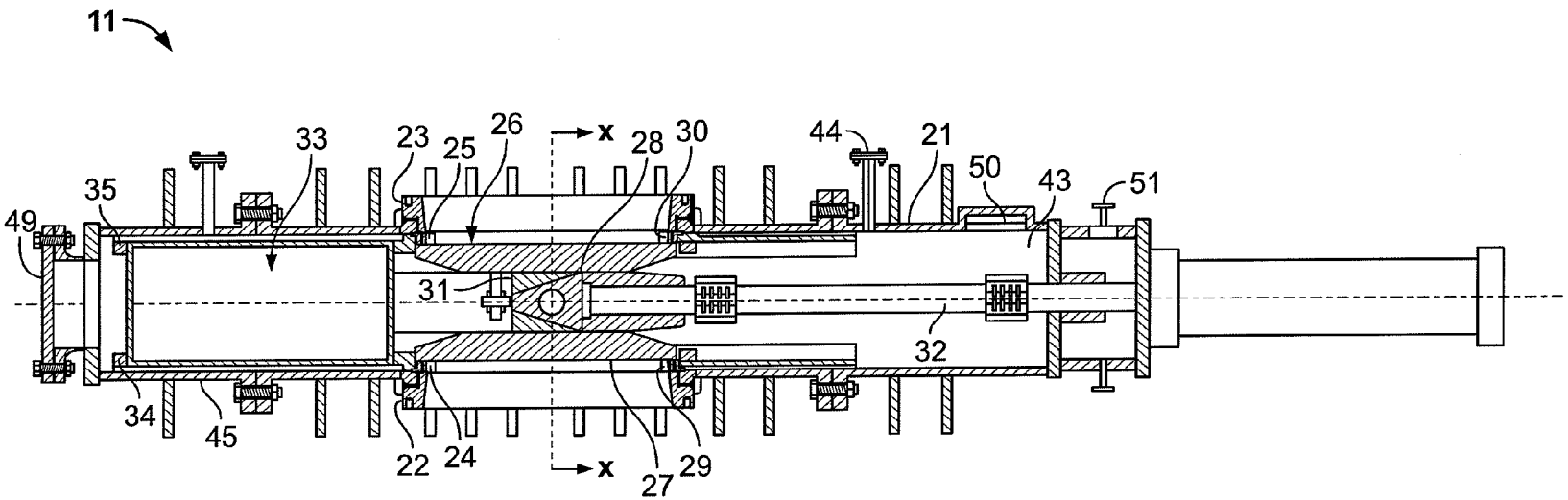
FIG. 2 is a view in section of the shut-off member of a coking plant.
Figure 3:
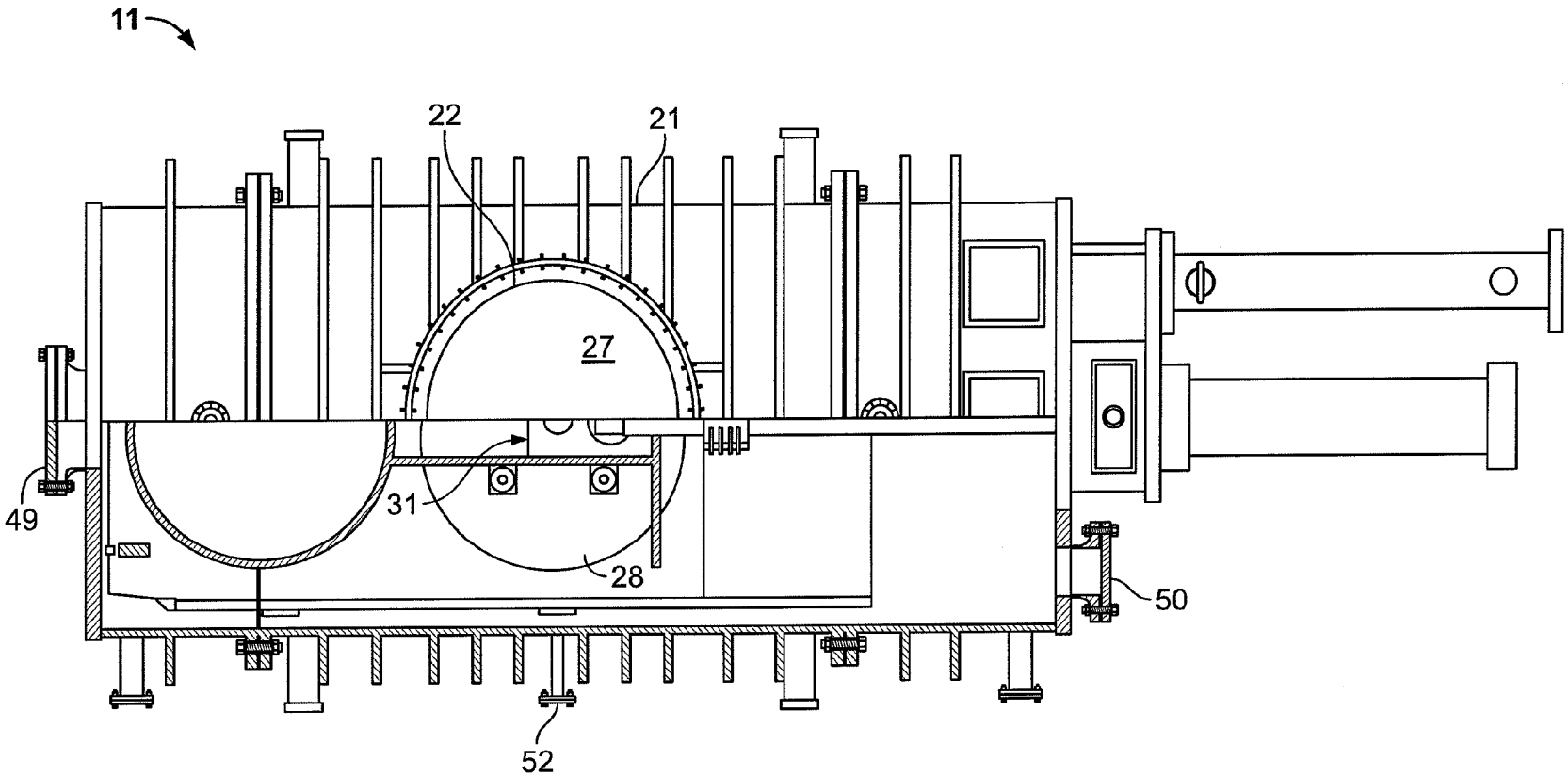
FIG. 3 shows the shut-off member of a coking plant with part of the housing removed.
Figure 5:
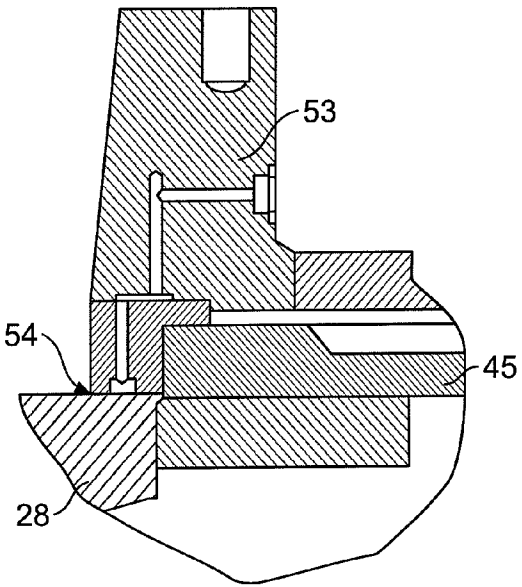
FIG. 5 is a detailed view of the part marked Y in FIG. 2.
Figure 4:
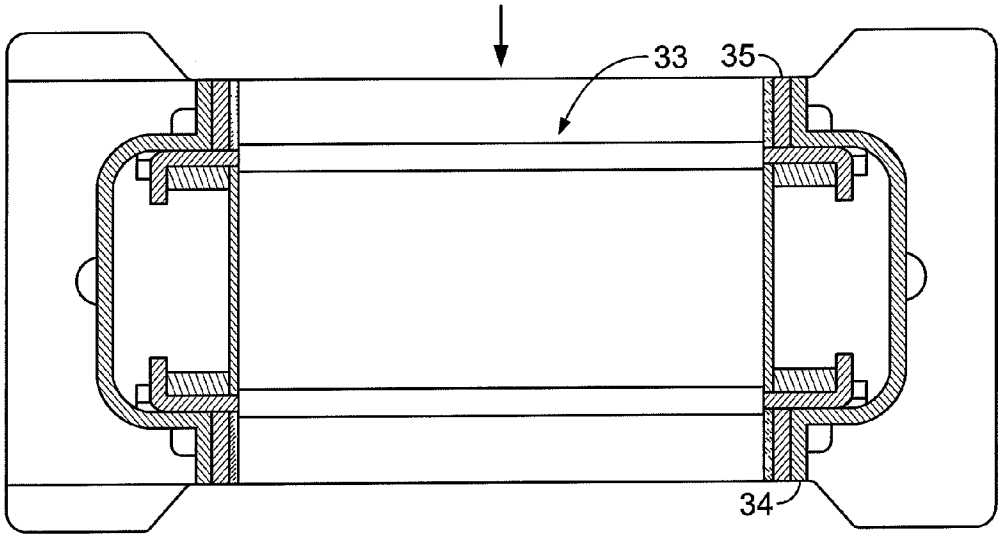
FIG. 4 is a view in section of the shut-off member of FIG. 2 along the axis X-X.

FIGS. 2, 3 and 4 are different views of a first embodiment of the shut-off member 11 for the coking chambers 3, 4. In addition, a detailed view of the region characterised by Y in FIG. 2 is shown in FIG. 5.

The slide valve shown has a slide valve housing 21 having two pipe sockets 22 and 23 as well as two housing sealing seats 24 and 25 between which two shut-off plates 27, 28 with sealing rings 29, 30 are displaceably mounted. The two shut-off plates 27 and 28 can be pressed against the housing sealing seats 24 and 25 by means of an internal wedge member 31, acting as an expander element, that sits at the end of a control rod 32 and is joined in fixed manner thereto. The shut-off plates 27, 28 can in addition be expanded according to a "wedge-in-wedge principle" by the internal wedge member 31, which is centred by means of a cone. This construction ensures that the slide valve is easy to operate even under the most difficult thermal and dynamic conditions. Jamming is not possible, since the internal wedge member 31 has a non self-inhibiting shape.

Arranged below and adjacent to the slide plate 26 is a bridging pipe 33 which has two sealing rings 34, 35. The bridging pipe 33 is in the form of a hollow cylinder, that is to say especially on its inner face is without undulation, so that any loss of flow caused by such undulation does not occur (see also FIG. 4 in that connection).

In FIGS. 2 and 3, the slide valve is shown in the closed position. The slide valve housing 21 is fluid-tight on the outside, so that it is possible to establish in the interior 43 of the slide valve housing a gas pressure that can also be greater than the pressure in the slide valve passageway. For that reason, the operating rod 32 is inserted fluid-tight into the slide valve housing 21.

Arranged on the slide valve housing 21 is a connection 44 for connecting to a pressurised gas source (not shown), especially a flushing steam source. By means of continuous flushing of the interior 43 of the slide valve housing, the baking on of contaminants and resultant malfunction of the coking chambers 3, 4 are substantially avoided. The sealing faces of the sealing rings 34, 35 on the one hand, and the housing sealing seats 24, 25 on the other hand, are each arranged extending parallel to the direction of operation of the slide valve. To increase resistance to wear, the aforementioned are hardened or armoured in a manner known per se.

The shut-off plates 27, 28 are movably mounted in a spectacle-shaped plate box (not shown in the Figures) which ensures the mounting thereof. The plate box is guided between guide plates 45, penetration of the housing by contaminants thereby being avoided.

Through inspection aperture 49, 50, in the form of a blind flange, it is possible to obtain ready access, especially to the bridging pipe 33, for observation purposes or the like.

The control rod 32 can be cooled, especially at the end thereof projecting from the housing, via a coolant inlet 51. The cooling is effect preferably by cold air or cold gases. It may be mentioned at this point that cooling with a liquid is also conceivable.

FIG. 4 shows the shut-off member 11 in its opened position along a line of intersection X-X in FIG. 2. It is clear therefrom that the bridging pipe 33 joins the pipe sockets 22, 23 without narrowing of the cross-section. In addition to the sealing rings 34, 35 and the housing sealing seat 24, 25, hardening or armouring of the entire inner face of the bridging pipe 33 is recommended in order thereby to prevent abrasive wear.

The region labelled Y in FIG. 2 is shown again in FIG. 5 on an enlarged scale. A flushing and shut-off steam channel 53, which is connected by a connection, nipple 52 (see FIG. 3) to a flushing and shut-off steam source, is clearly shown in the Figure. It is also possible in FIG. 5 to see a cutting edge 54 which is used to remove any adhering coke. The edge has a hard-armouring.

Figure 6:
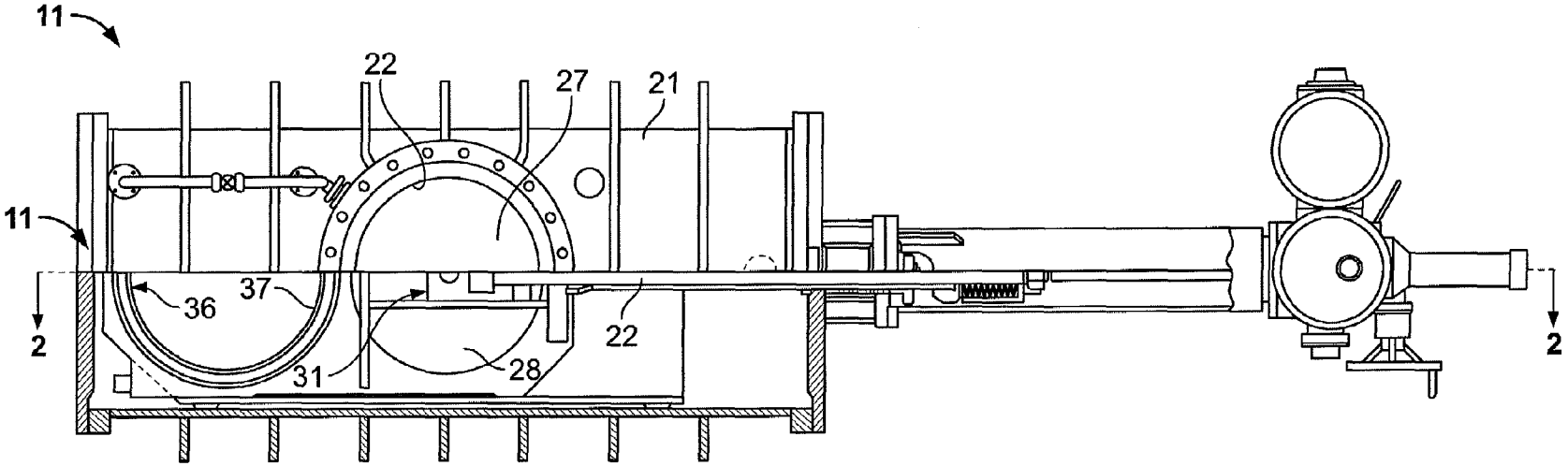
FIG. 6 is a partial view of a second embodiment of a shut-off member of the coking drum.
Figure 7:
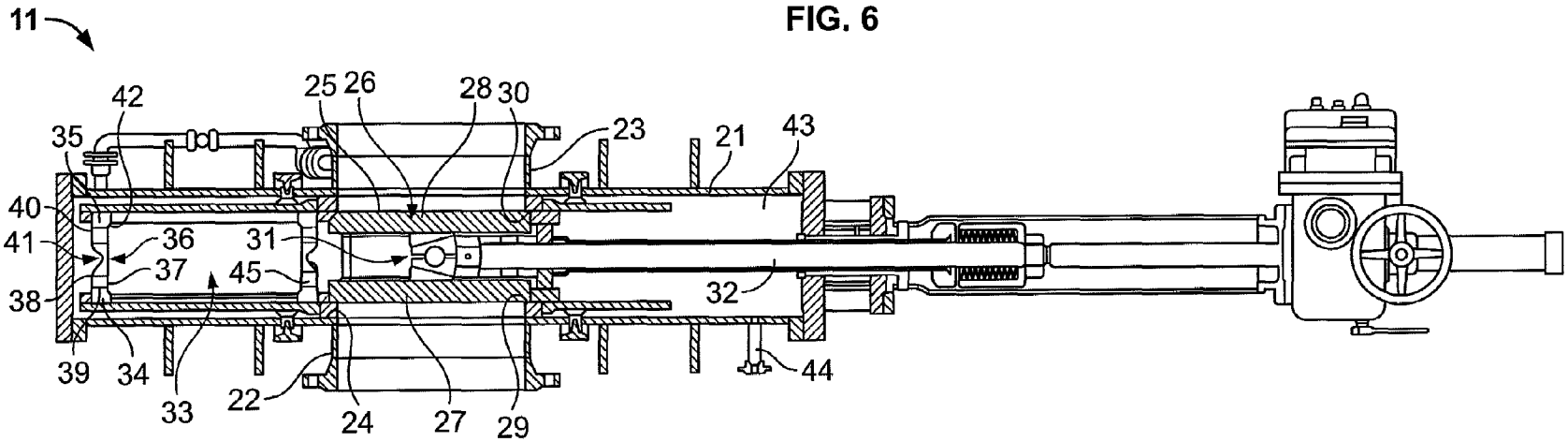
FIG. 7 is a section of the shut-off member according to FIG. 6 along the line II-II in FIG. 6.

FIGS. 6 and 7 show a second embodiment of the shut-off member 11 of the coking chamber 3, 4. Identical components and components having an identical function have the same reference numerals as the shut-off member according to the first embodiment (FIG. 2 to FIG. 5). They are therefore not further described in the following.

The bridging pipe 33 of the shut-off member 11 according to the second embodiment is composed of the sealing rings 34 and 35 and a compensator 36 connecting the sealing rings to one another. The compensator 36 consists of an inner pipe portion 37 and an outer pipe portion 38 extending coaxially thereto, the outer pipe portion 38 being joined in fixed manner to the two sealing rings 34, 35 by annular weld seams 39, 40.

The outer pipe portion 38 also has an undulation or concavity 41. The inner pipe portion 37 is of hollow cylindrical shape, that is to say is without undulation, so that analogously to the shut-off member 11 according to the first embodiment no trimming losses can occur. Furthermore, according to the second embodiment the inner pipe portion is joined in fixed manner only to one of the two sealing rings, in this case the sealing ring 35, by way of an annular weld seam 42. In relation to the other sealing ring 34, the inner pipe portion 37 is axially movable, the axial play between the sealing ring 34 and the inner pipe portion 37 being from approximately 1.0 mm to approximately 5.0 mm.

The arrangement of the inner pipe portion 36 in relation to the two sealing rings 34 and 35 is such that the inner face of the pipe portion 36 is flush with the inner faces of each of the sealing rings 34, 35, so that a practically uninterrupted flow passage is created when the slide valve is in the open position. Analogously to FIGS. 2 and 3, in each of FIGS. 6 and 7 the slide valve is in the closed position. The slide valve housing 21 is also fluid-tight on the outside in the second embodiment, so that, analogously to the first embodiment, it is possible for a gas pressure to be set inside the slide valve housing.

The circumferential concavity 41 of the outer pipe portion 38 extends to close to the outer face of the inner pipe portion 37, with the result that the gas pressure prevailing in the interior 43 of the housing has full effect, via the concavity 41, on the sealing rings 34, 35, expanding those rings axially. The axial expansion of the sealing rings 34, 35 is possible on the one hand as a result of the concavity 41 and on the other hand as a result of the axial play between the inner pipe portion 37 and one of the two sealing rings, in this case the sealing ring 34.

The bridging pipe 33 is accordingly bounded on the one hand by the two sealing rings 34, 35, and on the other hand by the inner and outer pipe portions 37, 38 arranged between the sealing rings and acting as a compensator 36, thereby forming an annular casing 46. This annular casing 46 or annular chamber between inner and outer pipe portions 37 and 38 is filled with a heat-insulating material, especially a glass wool, rock wool or the like.

The purpose of the filling is not only heat insulation but also to prevent the penetration of flow medium into the said annular chamber between inner and outer pipe portions. An addition of flow medium or, in the case of a gas flow, particles of dust and dirt or similar deposits, to the annular chamber would, after prolonged use, damage or impair the action of the compensator 36. In that respect the aforementioned embodiment has a double function.

In the context of a coking method known per se, which is explained in detail hereinabove in the description of FIG. 1, the use of a bridging pipe slide valve provides a special sealing feature. The introduction of flushing steam and the resultant action of steam (shut-off steam) on the interior 43 of the slide valve housing ensures optimum sealing of the particular coking drum 3, 4 in which coking is taking place at the time. In addition to a wedge being inserted between the two shut-off plates 27, 28, the latter are also, in addition, acted on by pressure, ensuring increased reliability.

The particular coking drum 3, 4 that has been filled is, on the other hand, cooled and the coke is removed from it. For that purpose first of all water is fed into the coking drum 3, 4 in order to cool the resulting hot coke. The coking drum 3, 4 is then opened to the atmosphere, the pressure prevailing in the interior of the coking drum 3, 4 pushing the shut-off plate facing the interior away from the valve seat and thus reducing the force required to open the bridging pipe slide valve. If, after opening the coking drum 3, 4, flushing or shut-off steam is again introduced into the interior 43 of the slide valve housing then, on the one hand, the housing and the components arranged in the housing are continuously cleaned and, on the other hand, as a result of the increased sealing action of the bridging pipe, the penetration into the housing of dust, which is produced in large measure when the coking drum 3, 4 is being emptied, is prevented.

Although the invention is described by way of embodiment examples having a fixed combination of features, it also includes other conceivable advantageous combinations of those features, as indicated especially, but not exhaustively, by the sub-claims. All features disclosed in the application documents are claimed as important to the invention insofar as they are novel, individually or in combination, compared with the prior art.

REFERENCE NUMERALS

1 furnace
2 pipeline
3 coking chamber
4 coking chamber
5 pipeline
6 conveyor belt
7 fractionating column
8 pipeline
9 furnace
10 pipeline
11 shut-off member
12 outlet
21 slide valve housing
22 pipe socket
23 pipe socket
24 housing sealing seat
25 housing sealing seat
26 slide plate
27 shut-off plate
28 shut-off plate
29 sealing ring
30 sealing ring
32 control rod
33 bridging pipe
34 sealing ring
35 sealing ring
36 compensator
37 inner pipe portion
38 outer pipe portion
39 annular weld seam
40 annular weld seam
41 undulation
42 annular weld seam
43 interior of the slide valve housing
44 connection
45 guide plate
46 annular casing
49 maintenance closure
50 maintenance closure
51 coolant inlet
52 connection nipple
53 flushing and shut-off steam channel
54 cutting edge That which is claimed:

1. Coking drum, especially for the manufacture of petroleum coke, having a substantially cylindrical basic body, at least one inlet and at least one outlet and a further access opening, wherein a shut-off member, comprising a bridging pipe slide valve having two shut-off plates and a slide valve housing, is arranged about at least one of the at least one outlet, the at least one inlet, and the further access opening; wherein the slide valve housing defines a connection connected to a pressurized gas source and configured to receive a pressurized gas, comprising one of a flushing steam and a shut-off steam, into the slide valve housing for at least one of flushing the slide valve housing and additionally sealing the slide valve housing.

2. Coking drum according to claim 1, further comprising wholly metallic sealing seats associated with the two shut-off plates and disposed in parallel to each other.

3. Coking drum according to claim 2, wherein the sealing seats include sealing seat faces having a wear-resistant and corrosion-resistant hard-armouring.

4. Coking drum according to claim 1, wherein the two shut-off plates are movably mounted in a spectacle-shaped plate box.

5. Coking drum according to claim 1, further comprising a bridging pipe formed as a hollow cylinder having a smooth surface, the bridging pipe being arranged such that, when the bridging pipe slide valve is in an open position, the bridging pipe connects two pipe sockets to each other, the two pipe sockets being arranged at a side of the bridging pipe slide valve facing the interior of the coking drum and at an opposite side thereto.

6. Coking drum according to claim 5, wherein the bridging pipe is at least one of hardened and provided with one of a wear-resistant and corrosion-resistant hard-armouring and a wear-resistant and corrosion-resistant coating on an inner face thereof.

7. Coking drum according to claim 1, wherein, in the closed position of the bridging pipe slide valve, the shut-off plates are pressed against sealing faces of the slide valve housing by wedge members centered by a cone.

8. Coking drum according to claim 4, wherein the bridging pipe slide valve further comprises guide plates in permanent metallic contact with the plate box.

9. Coking drum according to claim 1, wherein a control rod associated with the shut-off plates extends in a fluid-tight arrangement into the slide valve housing.

10. Coking drum according to claim 1, wherein hoods having a columnar cap for receiving a drive are flange-mounted on the slide valve housing.

11. Coking drum according to claim 1, wherein the bridging pipe slide valve has a compensator which compensates for gaps and for alignment inaccuracies when the bridging pipe slide valve is in an open position.

12. Coking drum according to claim 11, wherein the compensator comprises an outer pipe portion extending coaxially about an inner pipe portion, the outer pipe portion being configured as a wavelike-curved pipe portion having a concavity extending about the inner pipe portion, the inner pipe portion being fixed to only one of the two sealing rings and being configured to be axially movable in relation to the other of the two sealing rings.

* * * * *

UNITED STATES PATENT AND TRADEMARK OFFICE

CERTIFICATE OF CORRECTION

PATENT NO. : 7,666,280 B2
APPLICATION NO. : 11/624569
DATED : February 23, 2010
INVENTOR(S) : Ludwig Kersternich It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 323 days.

Signed and Sealed this

Seventh Day of December, 2010

David J. Kappos

David J. Kappos
*Director of the United States Patent and Trademark Office*